US005640743A

United States Patent [19]

Greene et al.

[11] Patent Number: 5,640,743

[45] Date of Patent: Jun. 24, 1997

[54] HOLDER FOR LONG SLENDER IMPLEMENTS

[76] Inventors: Leonard A. Greene, 206 Benedictine Court, Pickering, Ontario, Canada, L1X 1M6; Stephen Lienau, 34 Greyabbey Trail, West Hill, Ontario, Canada, M1E 1V7

[21] Appl. No.: 997,774

[22] Filed: Dec. 28, 1992

[51] Int. Cl.[6] ..... B43K 25/00

[52] U.S. Cl. ..... 24/10 R; 24/11 CT

[58] Field of Search ..... 24/3 R, 3 F, 3 H, 24/3 J, 3 L, 10 R, 10 A, 11 R, 11 PP, 11 CC, 11 CT, 11 HC, 11 S, 11 C, 17 AP, 16 PP, 67.11, 547, 339, 555; 248/74.2

[56] References Cited

U.S. PATENT DOCUMENTS

| | | | |
|---|---|---|---|
| D. 168,491 | 12/1952 | Alvarez . | |
| 918,125 | 4/1909 | Carson | 24/10 R |
| 1,102,350 | 7/1914 | Myers | 24/11 CT |
| 1,362,263 | 12/1920 | Perkins | 24/11 CT |
| 1,478,880 | 12/1923 | Otterbein . | |
| 1,890,134 | 12/1932 | Skovey | 24/11 CT |
| 2,320,561 | 6/1943 | Brady et al. | 24/10 R X |
| 2,423,948 | 7/1947 | Prince . | |
| 2,644,212 | 7/1953 | Markowitz | 24/10 R X |
| 2,802,250 | 8/1957 | Klotz . | |
| 3,212,146 | 10/1965 | Morgan . | |
| 3,429,450 | 2/1969 | Lambert . | |
| 3,597,802 | 8/1971 | White . | |
| 3,983,602 | 10/1976 | Barry . | |
| 4,505,006 | 3/1985 | Andre | 24/16 PB |
| 4,882,816 | 11/1989 | Murphy | 24/11 CT X |
| 5,066,154 | 11/1991 | Renaud . | |
| 5,140,723 | 8/1992 | Genzel . | |

*Primary Examiner*—Laurie K. Cranmer

*Attorney, Agent, or Firm*—Varnum, Riddering, Schmidt & Howlett

[57] ABSTRACT

A holder for long slender implements such as pencils and pens is disclosed. The holder comprises a support member which is preferably a thin web having opposed side surfaces. The web includes at least one opening that communicates with each of the side surfaces. Each side of the opening is surrounded by a plurality of flexible fingers which extend away from each side surface in a converging relationship so that the flexible fingers form a hollow frusto-conical shape that is preferably divided into equal segments. A long slender implement inserted through an opening in an outer end of the frusto conical shape forces the outer ends of the flexible fingers outward. The pressure exerted by the flexible fingers holds the long slender implement securely. The holder may be provided with a resilient clip, an adhesive or a magnetic base for attaching the holder to a variety of suitable surfaces.

21 Claims, 5 Drawing Sheets

HOLDER FOR LONG SLENDER IMPLEMENTS

FIELD OF THE INVENTION

The present invention relates to holders for long slender implements such as writing implements, and the like. In particular, the invention relates to a novel holder for long slender implements which securely holds pens, pencils and other generally tubular-shaped implements in a range of shapes and diameters.

BACKGROUND OF THE INVENTION

Holders for long slender implements such as pencils, pens and the like are well known and widely used.

The following United States patents are known to relate to this art:

| | |
|---|---|
| 1,478,880 - Otterbein | 3,579,820 - White |
| 168,491 - Alvarez | 3,983,620 - Barry |
| 2,802,250 - Klotz | 5,066,154 - Renaud |
| 3,212,146 - Morgan | 5,140,723 - Genzel |
| 3,429,450 - Lambert | |

While each of the patents listed above constitutes an advance in the art, most describe a holder which suffers from the disadvantage of being designed to accommodate a slender implement such as a pencil having a specific or standard diameter. Those holders are therefore limited in their usefulness because pens and pencils come in a variety of shapes and sizes. A holder described in the patents listed above which is not designed to accommodate a specific diameter of writing implement is described in U.S. Pat. No. 3,429,450 to Lambert. That holder suffers from the disadvantage of being useful only when retained in a horizontal orientation.

Another exception to the rule described above is U.S. Pat. No. 3,597,820 to white which describes a writing implement holder capable of accommodating slender implements of various diameters. The disadvantage of the writing implement holder described by white being that it is complicated and expensive to manufacture and therefore limited in its appeal.

SUMMARY OF THE INVENTION

It is an object of the invention to provide a holder for long slender implements which will securely hold implements having a variety of shapes and diameters while being simple to manufacture and use.

It is a further object of the invention to provide a holder for long slender implements which is inexpensively manufactured.

It is yet a further object of the invention to provide a holder for long slender implements which also provides a display surface for displaying graphic visual information such as a company logo or the like.

It is another object of the invention to provide a holder for long slender implements which may be secured to any surface in an attitude for accepting and holding such implements.

The present invention therefore provides a holder for long slender implements, comprising a support member having opposed first and second side surfaces and at least one opening communicating between the first and second side surfaces, the at least one opening being sized to accommodate a diameter of a largest implement to be held by the holder; a plurality of flexible fingers arranged in groups, each group of flexible fingers being respectively affixed to a side surface and surrounding a perimeter of the at least one opening and extending away from the respective side surfaces in a converging relationship to form a resilient segmented barrel for gripping a slender implement when inserted therethrough; and means associated with the support member for retaining same in an attitude for accepting and holding the long slender implements.

The holder for long slender implements in accordance with the invention therefore includes a support member which is preferably a planar web that includes at least one opening which communicates with the side surfaces. The opening must be large enough to slidably accommodate a diameter of the largest implement to be held by the holder. Surrounding each side of the opening are flexible fingers which extend away from the support member in a converging relationship. In accordance with a preferred embodiment, the resilient fingers comprise segments of a frusto-conical shaped projection on each side of the opening in the support member. The outer ends of each flexible finger preferably include an inward taper to facilitate the insertion of an implement. When a long slender implement is pressed into an opening defined by the outer ends of the flexible fingers, the flexible fingers are deflected outward to accommodate the implement. Assuming that the implement is sized to pass through the opening in the support member, it is readily forced through the flexible fingers on the opposite side of the opening and retained in that position by pressure applied equally about the perimeter of the implement by the flexible fingers. The pressure applied by the individual flexible fingers is gentle, yet unintentional dislodgement of the implement from the holder is substantially prevented. The holder in accordance with the invention is provided with a base attached to a bottom edge of the support member. The base is provided with means for retaining the support member in an attitude for accepting and holding the slender implements. The base may be a flat plate having a bottom surface which is covered with a magnetic pad for attaching the holder to a refrigerator, or any other surface having a ferrous content. The plate may likewise be covered with a contact adhesive, or the plate may be provided with a VELCRO™ system for securing it to a surface. In its most preferred form, the holder is provided with an integral resilient clip for attaching the holder to, for example, a cover of a book or a binder, a belt, a pocket or the sun visor of an automobile. The interior of the clip may be formed with additional gripping means, such as teeth and the like, to ensure that it remains safely secured once attached to a surface and to permit easy removal of a pen or pencil from the holder. In another embodiment of the invention, the holder with the resilient clip may also be used in a manner whereby the surface which normally holds advertising or other information is provided with means, such as two-sided tape, for securing the holder to a surface such as a refrigerator door. The resilient clip may then be used to hold a pad or block of paper. A holder in accordance with the invention may also be attached to clipboards of various sizes either as an appendage to the board or as an integral or appended part of a biased clip for retaining a pad of paper on the board.

BRIEF DESCRIPTION OF THE DRAWINGS

The invention will now be explained by way of example only and with reference to the following drawings wherein.

DETAILED DESCRIPTION OF THE PREFERRED EMBODIMENTS

Figure 1:
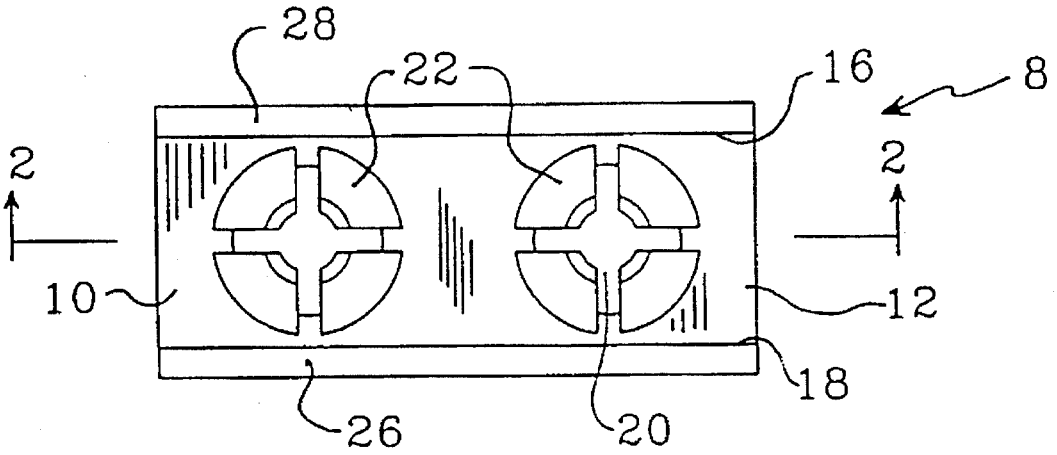
FIG. 1 is a side elevational view of one embodiment of a holder for slender implements in accordance with the invention.

FIG. 1 shows a side elevational view of a first embodiment of a holder for long slender implements in accordance with the invention. The holder, generally indicated by the reference 8, includes a support member which is preferably a relatively thin web having a first side surface 12 and a second side surface 14 (see FIG. 2). Each of the side surfaces 12, 14 includes a top edge 16 and a bottom edge 18. The support member 10 includes at least one opening 20 (in this case two are shown, but holders with one or three openings 20 are envisaged) which communicates with the first side surface 12 and the second side surface 14. The opening 20 is preferably a circular bore, although other shapes may also be used. Surrounding a periphery of the opening 20 on each side surface 12, 14 are a plurality of flexible fingers 22 arranged in groups which extend away from the side surfaces 12, 14 in a converging relationship (see FIG. 2) and preferably, but not necessarily form a hollow frusto-conical shape which is divided into four equal segments. The holder in accordance with this embodiment is provided with a flat base plate 26 which is affixed to the bottom edge 18 of the support member 10. The flat base plate 26 is used to attach the holder 8 to an appropriate surface. The holder 8 further preferably includes a top or outer surface 28 which is affixed to the top edge 16 of the support member 10. The top surface 28 is preferably a relatively wide flange or plate for providing a display area as will be explained in more detail with reference to FIG. 4.

Figure 2:
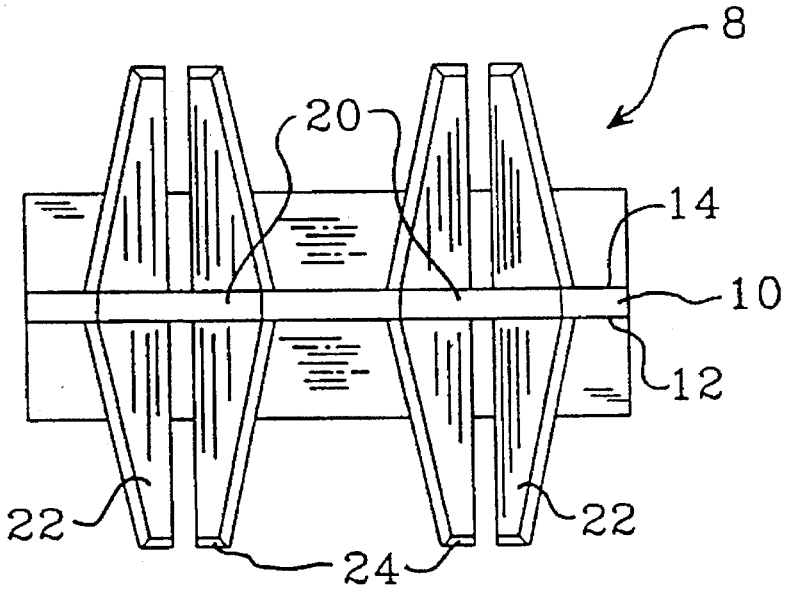
FIG. 2 is a cross-sectional view taken along lines 2—2 of FIG. 1.

FIG. 2 shows a cross-sectional view taken along lines 2—2 of the holder 8 shown in FIG. 1. As explained above, the flexible fingers 22 preferably form a frusto-conical shape. The frusto-conical shape preferably comprises four identical segments to form four flexible fingers 22. An outer end of each flexible finger 22 preferably includes an inward bevel 24 to facilitate the insertion of an implement. The holder 8 is preferably manufactured from a strong resilient plastic such as a high density polyethylene which may be injection molded to form an integral unit. Other strong, flexible materials may also be used, and examples include the commercially available plastics sold under the trade marks DELRIN and ACETOL. Although the holder 8 shown in FIGS. 1 and 2 has a capacity for holding two implements, holders for a single implement or for several implements may also be manufactured.

Figure 3:
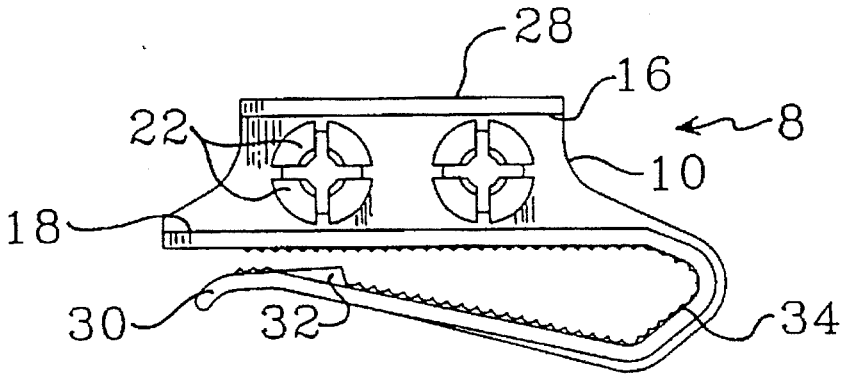
FIG. 3 is a side elevational view of a second embodiment of the invention.

FIG. 3 shows a side elevational view of an alternate embodiment of the invention. This embodiment is provided with a resilient clip 30 which is preferably molded as an integral part of the holder 8. The resilient clip 30 may be used to clip the holder 8 to any convenient surface such as the cover of a book, a tablet, a belt, a pocket, or a sun visor of an automobile. The resilient clip 30 is preferably provided with an integral wedge 32 to increase the holding ability of the clip when it is attached to a thin object. The clip also preferably includes transverse ribs 34 to facilitate the gripping action of the clip. Finally, the clip includes a longitudinal reinforcing rib 31 which extends along a portion of the exterior surface 34A which also contributes to the resiliency of the clip in that it ensures that the memory of the plastic material is augmented. The length of the clip 30 is also selected to be substantially the same as the length of the bottom edge 18. This ensures that the clip remains in place once attached to a visor and a pencil is inserted or withdrawn. Clips of other designs may be more appropriate for specific applications. A metal clip may also be attached to the flat base plate 26 using adhesive or fasteners, or the like, as an alternative to the integral molded plastic clip 30 which is illustrated.

Figure 4:
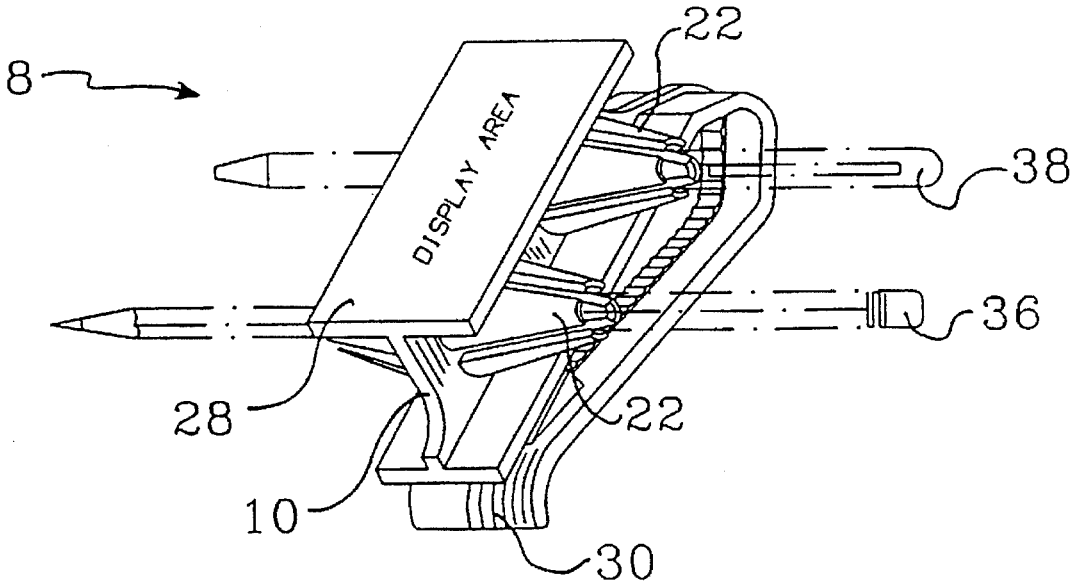
FIG. 4 is a perspective view of the embodiment shown in FIG. 3, showing in phantom lines a pencil and a pen held in the holder.

FIG. 4 shows a perspective view of the embodiment of the holder 8 shown in FIG. 3. A pencil 36 and a pen 38 are held by the holder 8. As is apparent, the pencil 36 and the pen 38 are retained in position by a pressure exerted by the outer ends of the flexible fingers 22. Because of the configuration of the flexible fingers 22, a moderate pressure is applied to each side of the pencil 36 and the pen 38. The holder 8 will accommodate implements such as pens and pencils having a relatively wide range of diameters and contours. Hexagonal pencils are held equally as well as round pens. Objects having a square or oblong contour are also readily accommodated. Practically any long slender implement which will pass through the opening 20 in the support member 10 (see FIGS. 1–3) is securely retained by flexible fingers 22 provided the implement has a diameter large enough that the flexible fingers 22 exert some pressure on the implement when inserted therebetween. The top surface 28 is preferably used as a display area for graphic and/or textual information. The information may be, for instance, a company name or logo, a slogan, an advertisement, a political message, or any other information which is desirably displayed for repetitive observation.

Figure 5:
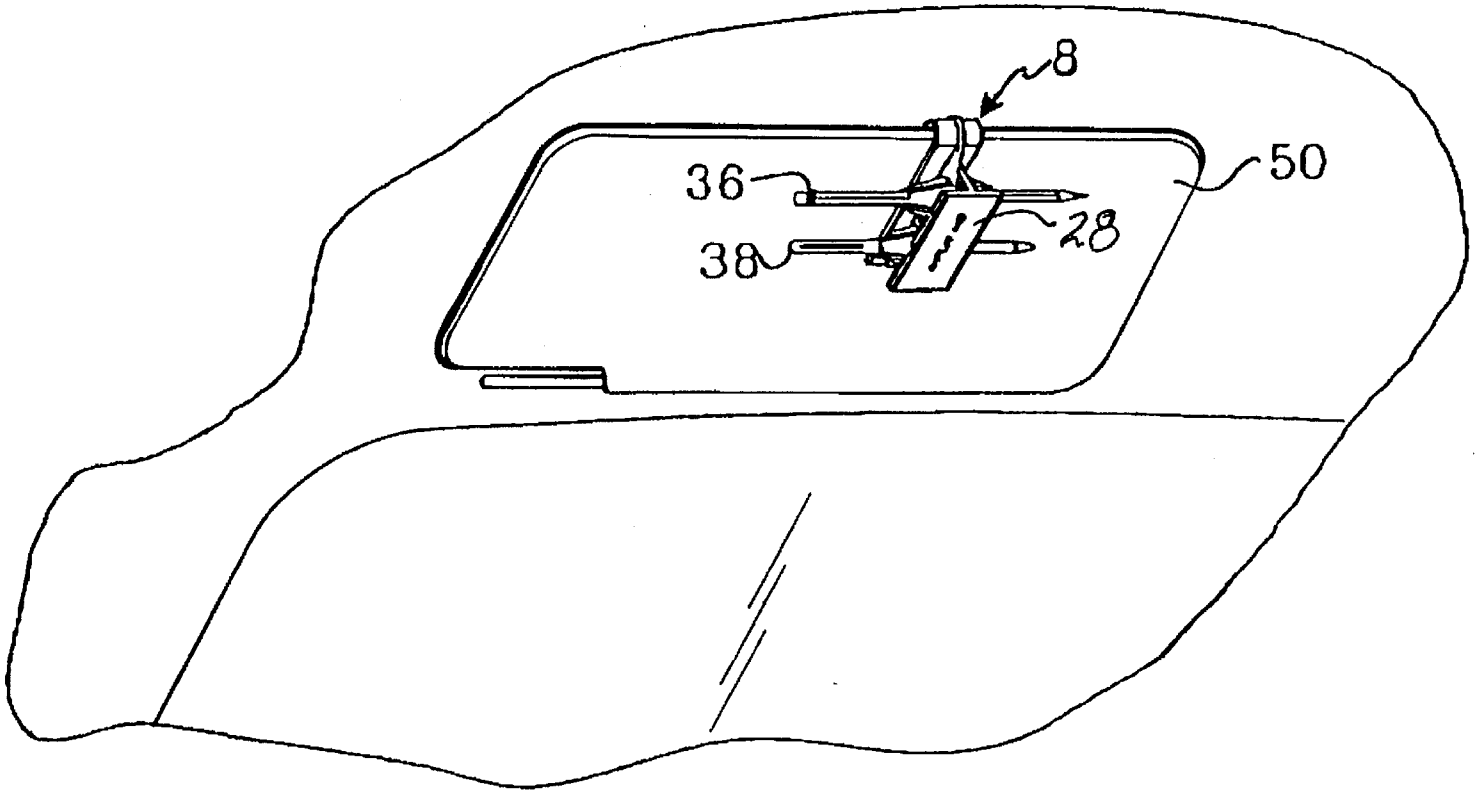
FIG. 5 is a front view showing the holder shown in FIG. 3 secured to a visor of a vehicle.

FIG. 5 shows the holder 8 secured to a visor 50 of a vehicle, with the visor in stored position. A pencil 38 and a pen 36 are shown in the holder. The holder is placed on the visor so that any information placed on the upper or outer surface 28 is visible.

Figure 6:
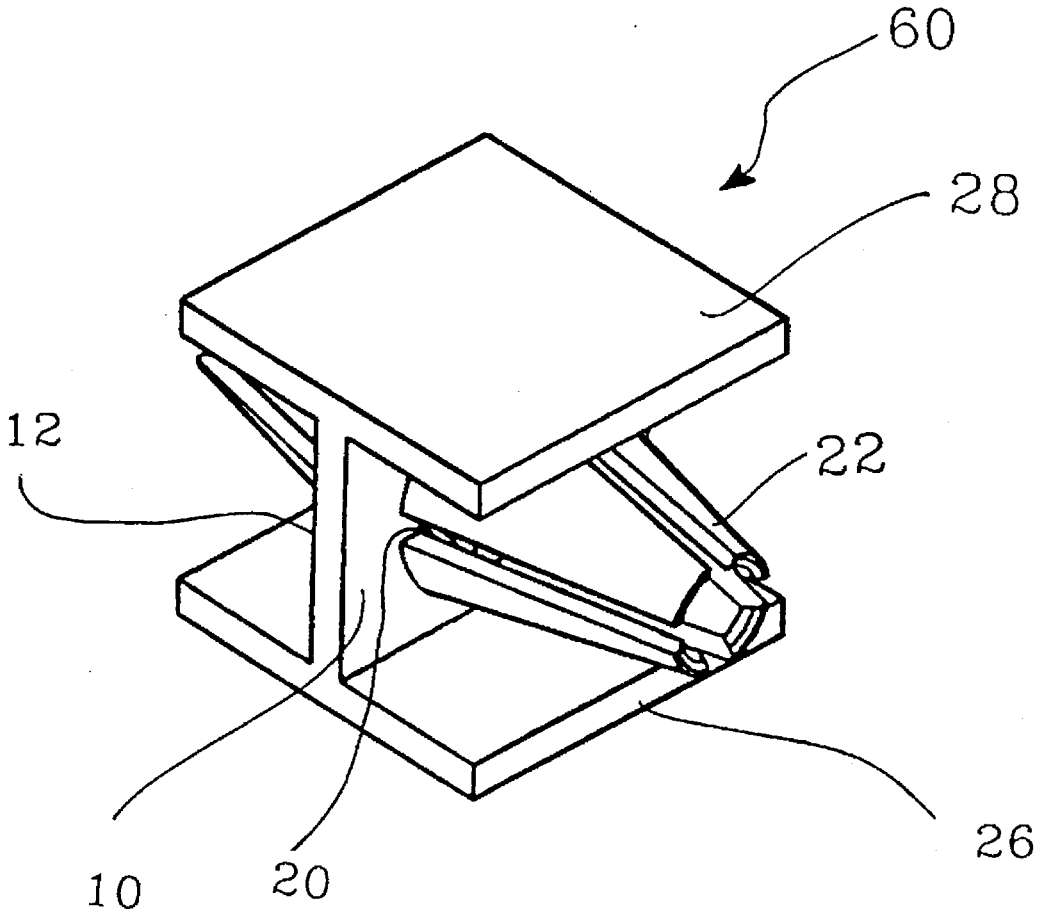
FIG. 6 is a perspective view of another embodiment of the present invention.

FIG. 6 shows another embodiment of a holder generally indicated at 60, which includes only one opening 20 with a set of four fingers 22. Surface 28 may contain written or graphical information (not shown), while the opposite surface 26 may be provided with suitable adhesive means for securing the holder 60 to a surface (not shown).

Figure 7:
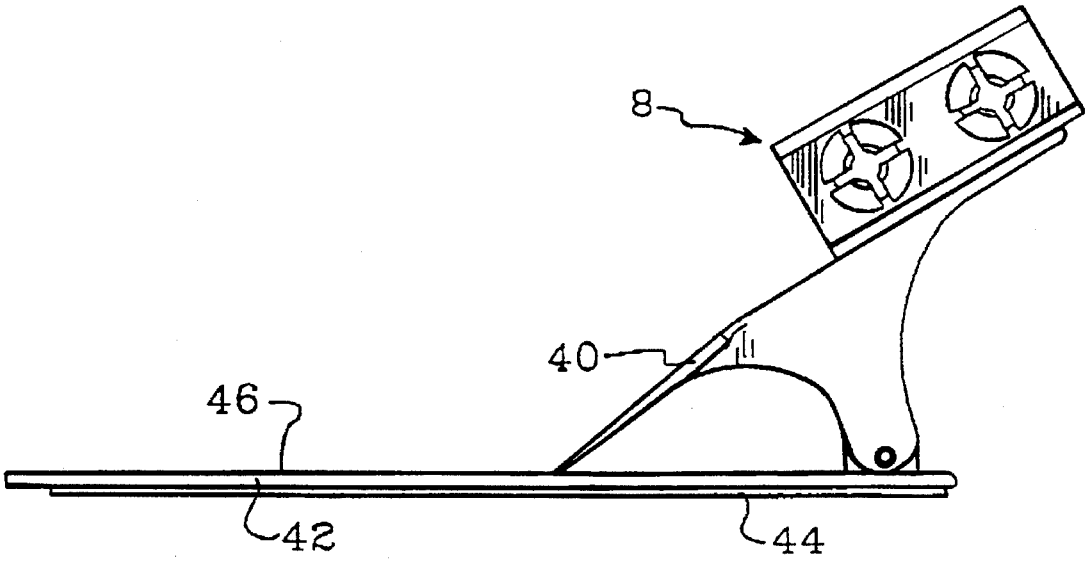
FIG. 7 is a side elevational view of a clipboard equipped with a holder for long slender implements in accordance with the invention.

FIG. 7 illustrates a side elevational view of yet another embodiment of the invention. In this embodiment, the holder 8 is attached to or integrally formed with the biased clip 40 of a clipboard 42. The clipboard 42 may be of a miniature size having a bottom surface covered with a magnetic pad 44 for attaching the clipboard to the door of a refrigerator or the like. Alternatively, the clipboard 42 may be a standard sized board. As noted above, the holder 8 may be attached to biased clip 40 on the clipboard 42 using an appropriate adhesive or fasteners such as rivets or the like. Alternatively, the biased clip 40 and the holder 8 may be integrally molded from a durable thermoplastic, or the like, and the top surface 28 (see FIG. 1) of the holder 8 may be used as a lever to facilitate acting against the bias of the clip 40 to release a notepad 46 from engagement by the clip.

The holder 8 may, of course, be applied to any number of utensils where a pencil, a pen, or a similarly shaped implement is advantageously stored. A simple single holder model may be advantageously manufactured for attachment to the side of a telephone, a bulletin board, a nightstand or the like. The holder may also be used to provide an attachment for a pencil or the like on a helmet or a hard hat for miners, divers or construction workers. It will be appreciated by those skilled in the art that the holder 8 for long slender implements may be advantageously used in a variety of diverse applications.

The embodiments hereinbefore described are intended to be illustrative only. Those skilled in the art may perceive changes and modifications which do not depart from the spirit of the invention. The scope of the invention is intended to be limited solely by the scope of the appended claims.

We claim:

1. A holder for long slender implements, comprising: a support member having opposed first and second side surfaces and at least one opening communicating between the first and second side surfaces, the at least one opening having a fixed diameter sized to accommodate a diameter of a largest implement to be held by the holder;

a plurality of flexible fingers arranged in groups respectively affixed to a side surface, each group respectively surrounding a perimeter of a side of the at least one opening and extending away from the respective side surface in a converging relationship to form a resilient segmented barrel for gripping a slender implement when inserted therethrough; and retaining means associated with the support member for retaining same in an attitude for accepting and holding the long slender implements.

2. The holder for long slender implements as claimed in claim 1 wherein the plurality of flexible fingers surrounding a perimeter of each side of the at least one opening comprise a hollow frusto-conical shape which is divided into four identical segments.

3. The holder for long slender implements as claimed in claim 2 wherein an end of each segment includes an inward bevel to facilitate the insertion of the long slender implements.

4. The holder for long slender implements as claimed in claim 1 wherein the means associated with the support member for retaining the support member in an attitude for accepting and holding the long slender implements comprises a resilient clip for gripping an edge of a thin object such as the sun visor of an automobile.

5. The holder for long slender implements as claimed in claim 4 wherein the support member, the flexible fingers and the resilient clip comprise an integral unit of plastic material.

6. The holder for long slender implements as claimed in claim 1 wherein the support member has an edge which supports a display area for graphic and textual information.

7. The holder for long slender implements as claimed in claim 6 wherein the display area comprises a plate which is affixed to the top edge of the support member in a plane that is orthogonal to the side surfaces of the support member.

8. The holder for long slender implements as claimed in claim 1 wherein the means associated with the support member for retaining the support member in an attitude for accepting and holding the long slender implements comprises a plate attached to a bottom edge of the support member, the plate including means for adhering the holder to a support surface.

9. The holder for long slender implements as claimed in claim 8 wherein the means for adhering the holder to a support surface comprises a magnetic pad affixed to the plate for magnetically adhering the holder to a surface having a ferrous content.

10. The holder for long slender implements as claimed in claim 8 wherein the means for adhering the holder to a support surface comprises a contact adhesive applied to a bottom surface of the plate for adhering the holder to a smooth support surface.

11. The holder for long slender implements as claimed in claim 1 wherein the means associated with the support member for retaining the support member in an attitude for accepting and holding the long slender implements comprises a board having a top surface and a bottom surface, the top surface being provided with a biased clip for retaining a thin object such as a pad of note paper and the support member is attached to a one of the top surface and the biased clip.

12. A holder for long slender writing implements, comprising: a support member having a top edge, a bottom edge and opposed side surfaces, the support member including at least one opening which communicates with each of the opposed side surfaces, the at least one opening having a fixed diameter sized to slidably accommodate a largest of the slender writing implements to be held by the holder;

a plurality of resilient gripping fingers attached in groups to the respective opposed side surfaces around a perimeter of each of the at least one opening, each group of the gripping fingers extending away from the respective opposed side surfaces in a converging relationship so that the resilient gripping fingers associated with each of the at least one opening define a hollow barrel with resilient segmented sides which exert a gripping pressure on the periphery of a long slender writing implement inserted therethrough;

a display area affixed to the top edge of the support member; and means affixed to a bottom edge of the support member for retaining the support member in an orientation suitable for accepting and holding the long slender writing implements.

13. A holder for long slender writing implements as claimed in claim 12, wherein the means affixed to a bottom edge of the support member for retaining the support member in an orientation suitable for accepting and holding the long slender writing implements comprises a plate affixed to the bottom edge of the support member, the plate having a top surface and a bottom surface, the bottom surface including means for attaching the holder to an appropriate support surface.

14. A holder for long slender writing implements as claimed in claim 13, wherein the means for attaching the holder to a support surface comprises a contact adhesive applied to the bottom surface of the plate so that the holder may be adhesively attached to an object having a smooth surface.

15. A holder for long slender writing implements as claimed in claim 13, wherein the means for attaching the holder to an appropriate support surface comprises a clipboard which includes a board and a biased clip for retaining a thin flat object such as a pad of note paper on the board, the support member being affixed to a one of the board and the biased clip.

16. A holder for long slender writing implements as claimed in claim 15, wherein the support member is affixed to a top edge of the biased clip and serves as a lever for acting against the bias of the clip so that a gripping edge of the clip may be displaced to insert or the remove an object such as a pad of note paper.

17. A holder for long slender writing implements as claimed in claim 12, wherein the means affixed to a bottom edge of the support member for retaining the support member in an orientation suitable for accepting and holding the long slender writing implements comprises a resilient clip affixed to the bottom edge of the support member, the clip being adapted for attaching the holder to an edge of a thin object such as a sun visor of an automobile.

18. A holder for long slender writing implements as claimed in claim 14, wherein the means for attaching the holder to an appropriate support surface comprises a magnetic pad affixed to the bottom surface of the plate so that the holder may be magnetically adhered to a surface of an object having a ferrous content.

19. A holder for writing implements which provides a display surface for graphic and textual information, the holder comprising, integrally formed and in combination:

a support member having a top edge, a bottom edge and opposed side surfaces, the support member including at least one opening which communicates with each of the opposed side surfaces, the at least one opening having a fixed diameter sized to slidably accommodate, while permitting quick and smooth removal of a diameter of a largest of the writing implements to be held by the holder;

a hollow resilient frusto-conical shaped gripping member attached to the respective opposed side surfaces around a perimeter of each of the at least one opening, the gripping member extending away from the respective opposed side surfaces and including a plurality of gripping finger segments which are deflected outwardly when a writing instrument is inserted therebetween, each segment exerting a pressure on the periphery of the writing implement to hold the writing implement in a supported condition;

a display area affixed to the top edge of the support member, the display area providing a surface for supporting a graphic information display; and means associated with a bottom edge of the support member for retaining the support member in an orientation suitable for accepting and holding the writing implements.

20. A holder for writing implements as claimed in claim 19, wherein the means associated with a bottom edge of the support member for retaining the support member in an orientation suitable for accepting and holding the writing implements comprises a resilient clip affixed to the bottom edge of the support member, the clip being adapted for attaching the holder to an edge of a thin object such as a sun visor of an automobile, the clip being of substantially the same length as the support member, the interior surface of the clip having a plurality of transverse parallel ribs and a wedge toward the open end of the clip to secure the holder to a surface and the exterior surface of the clip having a longitudinal reinforcing rib.

21. A holder for writing implements as claimed in claim 19, wherein the means associated with a bottom edge of the support member for retaining the support member in an orientation suitable for accepting and holding the writing implements comprises a plate affixed to the bottom edge of the support member, the plate having a top surface to which the bottom edge of the support member is attached and a bottom surface that includes means for attaching the holder to an appropriate surface.

* * * * *